United States Patent [19]

Desmond et al.

[11] 4,416,411

[45] Nov. 22, 1983

[54] SLEEVE-TYPE CARTON FOR TAPERED ARTICLES

[75] Inventors: John D. Desmond, Philadelphia, Pa.; B. Mesquida-Feirman, Forest Hills, N.Y.

[73] Assignee: Container Corporation of America, Chicago, Ill.

[21] Appl. No.: 387,018

[22] Filed: Jun. 10, 1982

[51] Int. Cl.[3] ..... B65D 5/02; B65D 65/10; B65D 75/06

[52] U.S. Cl. ..... 229/40; 206/427; 229/37 R

[58] Field of Search ..... 229/40, 37 R, 28 BC; 206/426, 427, 434

[56] References Cited

U.S. PATENT DOCUMENTS

| | | | |
|---|---|---|---|
| 3,598,302 | 8/1971 | Nowak | 229/40 |
| 3,604,560 | 9/1971 | Farquhar | 229/40 |
| 3,931,888 | 1/1976 | Fogel | 229/40 |
| 4,155,450 | 5/1979 | Schillinger | 229/40 |
| 4,164,286 | 8/1979 | Sutherland | 229/40 |
| 4,200,220 | 4/1980 | Garry | 229/40 |
| 4,314,640 | 2/1982 | Manizza | 229/40 |

*Primary Examiner*—Herbert F. Ross

*Attorney, Agent, or Firm*—Richard W. Carpenter; Davis Chin

[57] ABSTRACT

A sleeve-type carton formed of a unitary blank of foldable paperboard for holding a plurality of tapered articles.

1 Claim, 5 Drawing Figures

SLEEVE-TYPE CARTON FOR TAPERED ARTICLES

BACKGROUND OF THE INVENTION

1. Field of the Invention

This invention relates to sleeve-type cartons formed of paperboard, and more particularly to a carton adapted to enclose one or more tapered articles.

2. Description of the Prior Art

A prior art search directed to the subject matter of this application in the United States Patent and Trademark Office disclosed the following U.S. Pat. Nos.: 2,814,385; 2,840,233; 2,899,049; 2,911,096; 3,035,692; 3,081,928; 3,157,347; 3,163,322; 3,194,476; 3,229,892; 3,270,944; 3,275,218; 3,361,254; 3,381,881; 3,391,781; 3,424,302; 3,478,951; 3,604,614; 3,653,580; 3,999,660; 4,149,636; 4,164,286; 4,200,220; Re. 25,111; Re. 26,339.

None of the prior art patents uncovered in the search disclose a sleeve-type carton that is rectangular in cross-section and includes means for positioning the lower portion of a downwardly tapered article packaged therein.

SUMMARY OF THE INVENTION

This invention relates to sleeve-type cartons formed from one-piece blanks of foldable sheet material such as paperboard, and more particularly to a carton adapted to enclose one or more tapered articles.

It is common to provide tapered sleeves to hold tapered articles, but when a plurality of packages of this type are included within an outer shipping container they tend to move about within the container which can cause damage to the packaged articles.

It is therefore an object of this invention to provide a sleeve-type carton which is rectangular in cross-section but still accommodates the packaging of a plurality of tapered articles.

A more specific object of the invention is the provision, in a rectangular sleeve-type carton, of means for engaging the lower and narrower portion of a tapered article to prevent it from moving either transversely or lengthwise of the carton within which it is packaged.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 3:
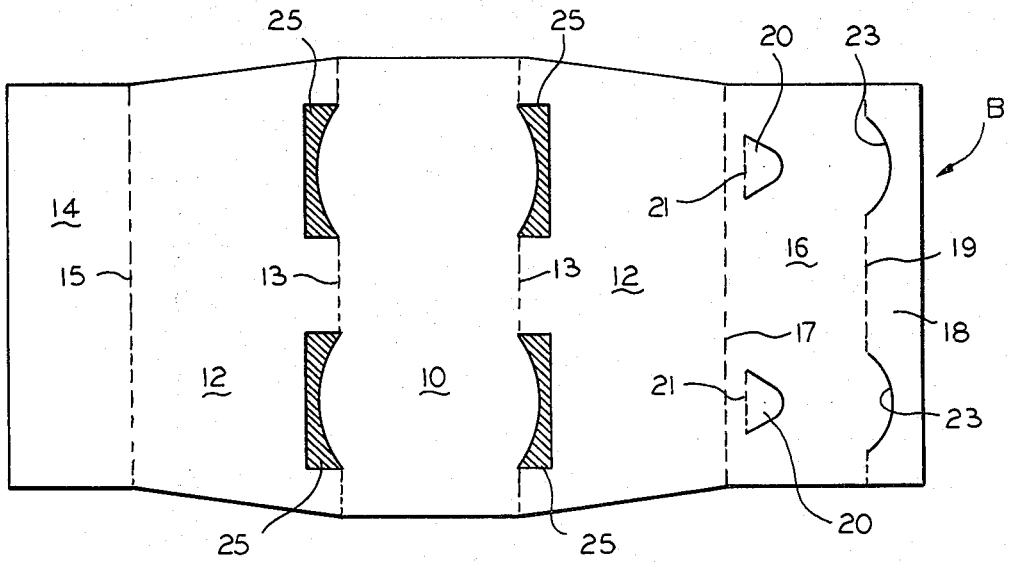
FIG. 3 is a plan view of a blank of foldable sheet material from which the carton illustrated in other views may be formed.
Figure 1:
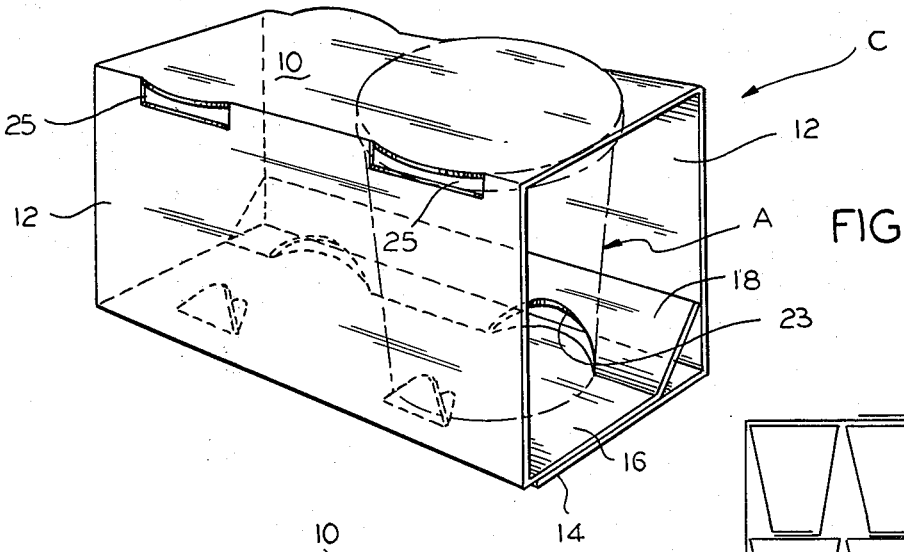
FIG. 1 is a perspective view of a carton embodying features of the invention, as shown in the erected position and with a packaged article positioned therein.

Referring now to the drawings for a better understanding of the invention, it will be seen that the novel sleeve-type carton indicated generally at C in FIG. 1 may be formed from the unitary blank B of foldable sheet material illustrated in FIG. 3.

The purpose of the carton C is to hold one or more tapered articles indicated generally at A.

Figure 4:
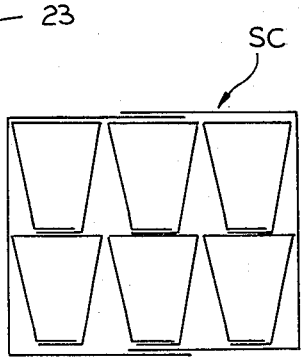
FIG. 4 is a schematic side view illustrating an outer shipping container holding a plurality of conventional tapered sleeves holding tapered articles.
Figure 2:
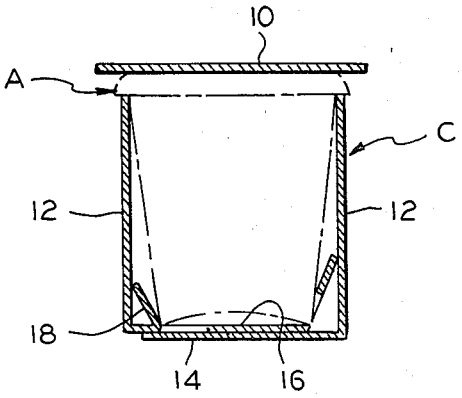
FIG. 2 is a fragmentary transverse vertical sectional view of the structure illustrated in FIG. 1.

By way of background, it should be understood that in the past it has been common to provide sleeve-type cartons for tapered articles wherein the cartons themselves are tapered and have converging side walls. As best seen in FIG. 4, when cartons of this type are packaged within an outer container, extra space is developed between the narrower portions of the adjacent cartons. This permits the cartons to move about within the outer container which can cause damage to the packaged articles.

Figure 5:
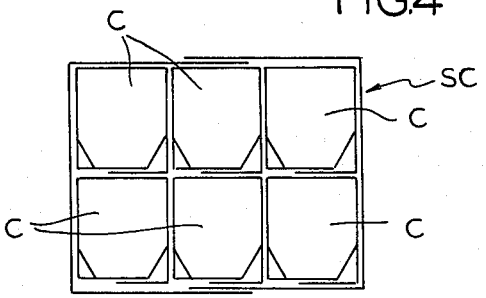
FIG. 5 is a view similar to FIG. 4 but showing an outer container holding a plurality of cartons embodying the present invention.

It is therefore an object of this invention to provide a rectangular carton for a tapered article, so that when the carton is packaged with a plurality of similar packages, there will be a snug fit within an outer container, as illustrated in FIG. 5.

In order to utilize a rectangular carton for tapered articles it is necessary to provide means for securing the narrower portions of the article within the sleeve, as is described later in the specification.

Still referring to FIGS. 1 and 3, it will be seen that the novel carton C includes a top wall, indicated generally at 10, having a pair of opposed side walls 12 foldably joined at their upper edges along fold lines 13 to opposite side edges of top wall panel 10.

The bottom wall of the carton includes a pair of outer and inner panels 14 and 16 which are foldably joined along fold lines 15 and 17, respectively, to lower edges of side wall panels 12. A relatively narrow retaining panel 18 is foldably joined along fold line 19 to an edge of inner bottom wall panel 16. Panel 18, as best seen in FIG. 1, is of slightly less width than outer bottom wall panel 14.

Inner bottom wall panel 16 presents a plurality of tabs 20, which are cut from the inner bottom wall panel and are foldably joined thereto on fold lines 21. Tabs 20 are adapted to extend upwardly and engage lower portions of the articles packaged therein to prevent the articles from moving toward the related side wall panel 12.

As best seen in FIG. 1, retaining panel 18 is adapted to extend diagonally upward from one edge of inner bottom wall panel 16 to the related side wall panel 12. Retaining panel 18 is provided with a plurality of openings 23 adapted to receive lower portions of the packaged articles at locations opposite the locations where they are engaged by the tabs 20. Openings 23 serve to position the packaged articles and prevent them from shifting either transversely or longitudinally of the carton.

At the upper edge of the carton side wall panels 12 may be provided with openings 25 adjacent the top wall panel 10. The purpose of these openings is to receive upper portions of the packaged articles and to position the articles and prevent their movement either transversely or longitudinally within the carton. If desired the carton may be provided with gussets or narrow end panels (not shown) at opposite ends to prevent movement of the packaged articles in a direction lengthwise of the carton. These would replace the previously mentioned openings 25.

Thus, it will be appreciated that the invention provides a unique carton arrangement wherein a sleeve-type carton of rectangular configuration can be employed to package tapered articles because of the novel securing means therein. This arrangement permits the cartons to be packaged in outer shipping containers in such a way as to minimize space between adjacent cartons to prevent or limit the cartons from moving about within the outer containers.

What is claimed is:

1. A sleeve-type carton, for enclosing at least two articles which are tapered throughout substantially their entire height, said carton being formed of a unitary blank of foldable sheet material, such as paperboard, and comprising:

(a) pairs of opposed top and bottom and side walls foldably interconnected to form a rectangular, tubular structure open at the ends;

(b) said side walls being parallel to each other throughout their height and having, adjacent the upper edges thereof, openings for receiving the upper portions of said packaged articles and preventing the movement thereof within said structure;

(c) said bottom wall being joined to said side walls at corners which are uninterrupted throughout their length;

(d) said bottom wall including:

(i) tabs projecting upwardly therefrom for engagement with a lower portion of said articles to prevent the movement of said articles toward a side wall of said structure;

(ii) an internal panel sloping upwardly toward an adjacent side wall and presenting an opening for receiving lower portions of said article and preventing the movement of said articles toward an end of said structure.

* * * * *